US005640745A

United States Patent [19]

Bertsch et al.

[11] Patent Number: 5,640,745

[45] Date of Patent: Jun. 24, 1997

[54] METHOD AND APPARATUS FOR THE MANUFACTURE OF A MIXED YARN USING MULTIFILAMENT YARN AND FIBERS

[75] Inventors: Gotthilf Bertsch, Ebnat-Kappel; Erwin Schwarz, Ulisbach; Albert Rebsamen, Speicher, all of Switzerland

[73] Assignee: Heberlein Maschinenfabrik AG, Wattwil, Switzerland

[21] Appl. No.: 454,365

[22] PCT Filed: Feb. 28, 1995

[86] PCT No.: PCT/CH95/00046

§ 371 Date: Jan. 26, 1996

§ 102(e) Date: Jan. 26, 1996

[87] PCT Pub. No.: WO95/23886

PCT Pub. Date: Sep. 8, 1995

[30] Foreign Application Priority Data

Mar. 1, 1994 [CH] Switzerland ..... 600/94

[51] Int. Cl.[6] ..... D02G 1/16

[52] U.S. Cl. ..... 28/252; 28/276; 28/258; 57/208; 57/350

[58] Field of Search ..... 28/252, 276, 258; 57/208, 350

[56] References Cited

U.S. PATENT DOCUMENTS

| | | | |
|---|---|---|---|
| 3,093,878 | 6/1963 | Fieldman et al. | 28/252 |
| 3,474,613 | 10/1969 | Joarder et al. | 28/252 |
| 3,822,543 | 7/1974 | Edagawa et al. . | |
| 4,064,686 | 12/1977 | Whitted et al. | 57/208 |
| 5,182,900 | 2/1993 | Horak et al. | 57/350 |

FOREIGN PATENT DOCUMENTS

| | | | |
|---|---|---|---|
| 0 098 354 | 1/1984 | European Pat. Off. | 28/252 |
| 51-2975 | 1/1976 | Japan | 28/252 |

*Primary Examiner*—Andy Falik

*Attorney, Agent, or Firm*—Finnegan, Henderson, Farabow, Garrett & Dunner, L.L.P.

[57] ABSTRACT

An apparatus and method for the manufacture of a mixed yarn consisting of two components, continuous filament yarn and staple fibers. The mixed yarn is manufactured by an air jet texturing process. It has been possible to bind the staple fibers undisplaceably into the yarn, and this is ensured by the loops on the continuous filaments produced during texturing. Owing to the formation of a suction zone of the airstream directly before the beginning of actual texturing, the staple fibers can be sucked in and can be blended into the interior of the yarn and can be secured firmly in the yarn by the loops. The invention relates to a new method of manufacture and to an apparatus, or an entire machine, with which the known loop yarn or the new mixed yarn can now be manufactured selectively.

30 Claims, 5 Drawing Sheets

FIG 1
(PRIOR ART)
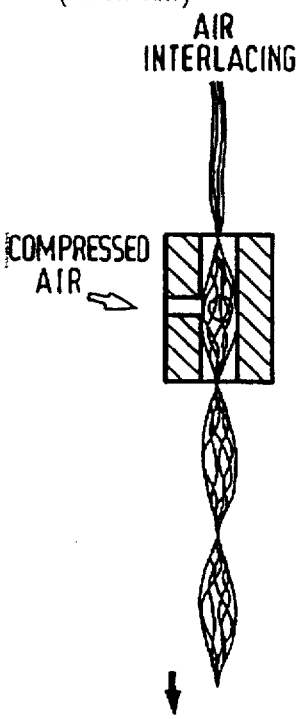
FIG 3
(PRIOR ART)
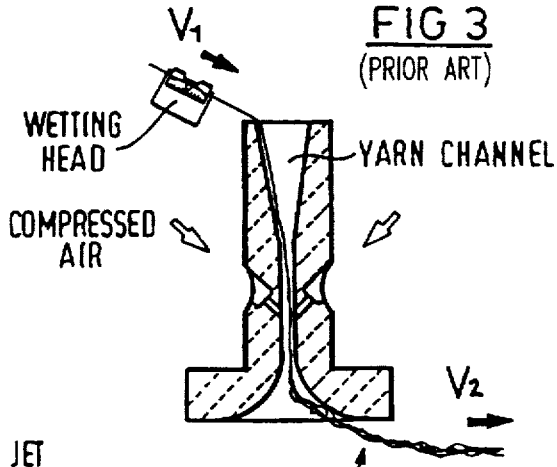
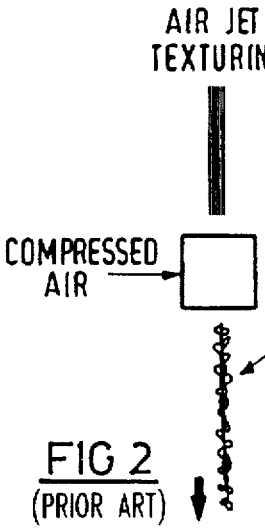
FIG 2
(PRIOR ART)
FIG 4
(PRIOR ART)
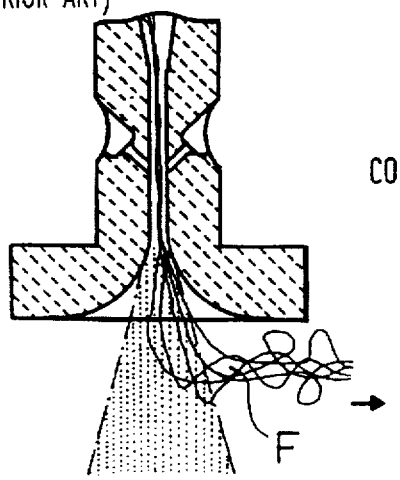
FIG 5
(PRIOR ART)
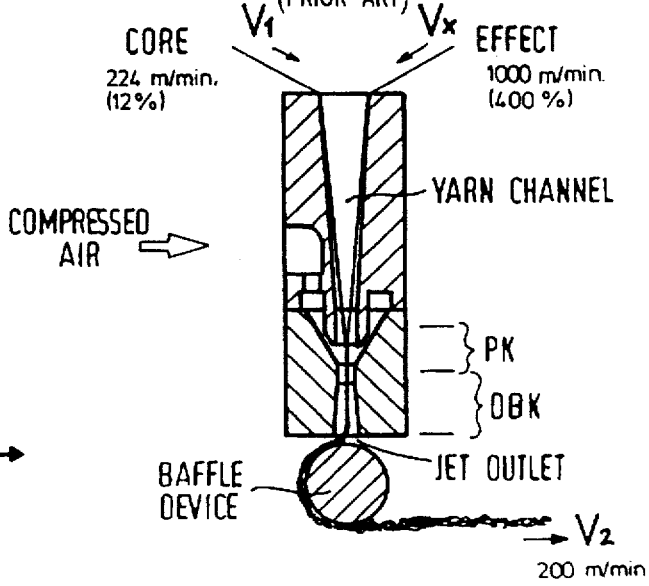

METHOD AND APPARATUS FOR THE MANUFACTURE OF A MIXED YARN USING MULTIFILAMENT YARN AND FIBERS

The invention relates to a method and an apparatus for producing and modifying a mixed yarn, consisting of at least one continuous filament yarn and staple fibers, in an airstream, wherein the airstream guides the continuous filament yarn.

BACKGROUND OF THE INVENTION

The conventional yarn manufactured from natural fibers such as cotton or wool by spinning imparts a respective typical textile character to the end product owing to the properties of the raw materials and to the spinning process. Since the introduction of so-called artificial silk, many methods of manufacture of the yarn on the one hand and for the treatment or the modification of the yarns on the other hand have arisen. In particular, two air technologies have become established in the market place for the modification of filament yarns. Both technologies are based on already spun continuous filament yarns, whether of artificial or natural silk.

Air interlacing technology which is shown schematically in FIG. 1 allows the manufacture of composite yarns. For example, a combination of filament yarn and fiber yarn or of two filament yarns is manufactured. In contrast to the air spinning of staple fibers, air interlacing technology necessitates a filament yarn in order to interlace the fiber yarn component. Air-interlaced composite yarns are additionally modified for particular applications. However, they are usually already finished products for subsequent processing such as weaving, knitting, etc. Special properties and effects which cannot be achieved by the spinning process can be manufactured by air interlacing technology.

The second air technology which has become established in industrial practice is so-called air jet texturing. This is shown schematically in FIG. 2. Air jet texturing allows a single continuous filament yarn to be treated or two (or more) continuous filament yarns to be combined to form a composite yarn and to be modified. Air jet texturing began in the fifties. It allows a so-called loop yarn to be manufactured from one or more smooth continuous filament yarns. The main item for air jet texturing is the air texturing jet which is shown on a larger scale in a simplified section in FIG. 3. The feed velocity ($V_1$) of the filament yarn to the air texturing jet is higher than the output or take-off velocity ($V_2$). The different velocity, described as overfeed, is required for forming the loops. The corresponding lengthwise displacements between the filaments is triggered by the energy of the flowing air. Loop formation results in an effective reduction in the yarn length. The jet therefore becomes a "yarn consumer" so to speak, i.e. more yarn is introduced than taken off owing to the higher intake velocity than output velocity. However, the quantity of yarn which is assumed to be absent can be found again in the form of loops and leads to an increase in the count after the jet. A model of loop formation is shown in FIG. 4. A braiding point "F" is usually defined.

To deflect the already textured yarn, a baffle device is very frequently arranged directly after the outlet from the texturing jet (FIG. 5). The compressed air can be introduced in parallel (FIG. 5) or, as shown in FIG. 3, radially into the yarn channel. It is possible to introduce two or even more continuous filament yarns simultaneously into the yarn channel and to combine them to form a textured yarn, for example so-called effect or bulk yarns. FIG. 5 shows the yarn channel in the lower portion as a compressed air inlet channel (PK) and subsequent jet channel (DBK). The compressed air is supplied to the jet head at 5–15 bar, preferably 6–10 bar. As a result of the high feed pressure, a supersonic airflow is manufactured if the jet, in particular the jet channel or jet accelerating channel (DBK) is of a suitable design. It is usually acknowledged by specialists that the success of air jet texturing is due to the utilisation of the phenomenon of the supersonic airflow, in particular the known shock waves and rapid sequence of compaction and expansion of the air. With precise manufacture and ideal shaping of the compressed air inlet channel (PK) and the jet channel (DBK), the supersonic phenomena are also obtained if one or more smooth filament yarns are guided through the jet channel. Recent investigations have shown that higher frequency oscillations are superimposed on the compaction waves and eventually manufacture the loops on the filaments together with the alternating shock waves. The filament yarns are preferably guided by the yarn channel into the center of the jet stream. The compact yarn is taken off at right angles after issuing from the jet in the region of the braiding point (F). It is assumed that bunching coincides very exactly with a compaction point of the airstream. This method has successfully been used worldwide for the manufacture of various yarn qualities for over twenty years.

Numerous attempts have been made in the past to manufacture mixed yarns from continuous filament yarn and staple fibers using the airstream principle. However, there is no known method for achieving a quality comparable to a spun blended yarn. All corresponding developments have failed up until now.

For example, U.S. Pat. No. 3,822,543 demonstrates, by many embodiments, an idea for the manufacture of a mixed yarn in an airstream which has probably never been adopted in industrial practice. The starting point is the guidance of the continuous filament yarn and of the staple fibers by the compressed airstream into and through a turbulence zone or turbulence chamber. It is also proposed that the air turbulence be manufactured by various techniques. Extreme air forces are used as a basis in the above-described air jet texturing. For manufacture of the mixed yarn by the turbulence method, however, air velocities of only 1200 m/min or 20 m/sec are proposed. It is improbable that a mixed yarn can be manufactured industrially in this way.

SUMMARY OF THE INVENTION

Hereinafter, the term "mixed yarn" denotes a composite yarn manufactured from continuous filament yarn and staple fibers. The continuous filament yarn is usually manufactured from man-made fibers, optionally also from natural silk, and the staple fibers can be natural products such as cotton, wool, etc. or also staple fibers composed of man-made fibers. In specialised terminology, the term "mixed yarn" is often also interpreted as a spun yarn composed of various staple fibers (man-made fibers and natural fibers). This yarn will hereinafter be described as "blended yarn".

In an embodiment of the invention it is possible to manufacture, in an airstream, a mixed yarn which has substantially all naturally possible advantages from the combination of continuous filament yarn and staple fibers and can be used in industrial practice, and it should also be possible to manufacture, in particular, a twist-free yarn.

The method according to the invention is characterized in one aspect in that the airstream which guides the continuous filament yarn forms a suction zone through which the staple fibers are mixed with the continuous filament yarn and continuous filament yarn is air jet textured with staple fibers as mixed yarn.

It has been demonstrated by many experiments that the texturing of filament yarn with staple fibers by air jet texturing is possible according to the new invention and quite surprisingly yields good results. The experiments have also confirmed that industrial production can be carried out for a wide variety of applications by employing several particularly advantageous designs. A breakthrough for the inexpensive manufacture of mixed yarns without a twist in the yarn with a quality comparable to a spun composite yarn has thus been achieved for the first time. It is not possible to describe the exact process during air jet texturing, even less the exact process for the firm binding in of staple fibers according to the new invention. According to a convincing model of the new invention, the process proceeds in the following four main stages;

- the filament yarn is overfed through a widening jet acceleration channel of an air texturing jet and is opened;
- staple fibers are sucked into the opened filament yarn by the airstream using a feeder and are blended in;
- the airstream is converted into a shock wave stream forming, on the filaments, loops which embrace and bind the staple fibers; whereupon
- the textured mixed yarn is taken off substantially at right angles in the region of the braiding zone.

It is interesting to note that the filament yarn and the staple fibers can be braided into one another but each assume a completely different form. The loops formed on the filaments of the continuous filament yarn are initially radially outwardly directed vaults of the filaments. The closer the vaults are to the braiding point, the stronger the effect of the overfeed with the result that the vaults cover one another by about 90° and form the actual loops. As they curve outwardly, the staple fibers from the interior are grasped and also moved outwardly into the curvature. During subsequent rotation of the vault transversely to the airstream or to the formation of loops, the staple fibers are entrained and bound undisplaceably into the respective loop. However, as the successive vaults invariably adopt alternating directions on each individual filament, a binding effect which is equivalent to that during spinning is obtained for the staple fibers but without a genuine twist.

According to a very advantageous embodiment, an annular gap for feeding the staple fibers is formed in a first portion of the suction zone, the annular gap being arranged over the entire periphery or only over a portion of the periphery. The annular gap does not serve to introduce the fibers uniformly over the entire periphery but rather desirably to influence the airstream. Experiments have shown that it is sufficient if the staple fibers are introduced only at one point or at individual points of the periphery. The suction zone is preferably designed as a suction blending chamber in such a way that a free outlet cross section is formed in the direction of the airstream and the majority of air jet texturing is carried out outside the suction blending chamber.

On the basis of the earlier experiments, the best results could be achieved by opening the continuous filament yarn before its entry into the suction blending chamber by means of a jet acceleration channel which preferably widens steadily. A supersonic airflow is adjusted in this acceleration channel if it is of a suitable design and there is adequate air pressure (preferably higher than 4 bar feed pressure). It has been found that the airflow is stable and, in particular, the opening process proceeds very reliably. A good design of the shock wave airflow, beginning in the suction blending chamber, also appears particularly important. The transition from the jet channel into the suction blending chamber is preferably formed by an irregular widening of the cross section or a jump in the cross section so a pronounced vacuum zone is manufactured therein. The staple fibers can be sucked into the suction blending chamber via a bore or an annular gap. It is probably the steady alternation of compaction and expansion of the airstream and of the braiding process which allows the staple fibers to be undisplaceably bound into the opened continuous filament yarn. The breakthrough was actually achieved only by the success of this good binding. It is advantageous if the suction blending chamber is limited at the back and at the sides in the manner of an enveloping bell, is completely open in the direction of flow and preferably passes directly into a free loop forming portion. In the past, the best product qualities could actually be achieved if the suction blending chamber was open in the direction of flow and loop formation and the braiding zone (braiding point F) were impact-free. However, brief tests have shown that a baffle member can also be used. However, it was decisive in all experiments that the textured mixed yarn be taken from the braiding point substantially at right angles to the airstream. The staple fibers are advantageously introduced into the suction blending chamber on one side with only one intake, preferably with a radial component, and the textured mixed yarn removed from the braiding point, but in the opposite direction to the feed direction of the staple fibers.

The invention also relates to apparatus for manufacturing a mixed yarn from at least one continuous filament yarn and staple fibers and is characterized in that it comprises an air texturing jet and a suction blending head with a feeder device for staple fibers.

The suction blending head is preferably arranged at the outlet end of the air texturing jet and after the jet acceleration channel and preferably has an orifice for the feeding of the staple fibers in the transition region. The suction blending head also forms a free outlet cross section, a barrier device advantageously being arranged on the side of the feeder device for the staple fibers. This prevents the suction stream from having a detrimental effect on the supply of staple fibers. It was also possible to manufacture a mixed yarn if the feed orifice to the suction zone for the staple fibers was arranged between the compressed air inlet channel and the jet/acceleration channel or if the feed orifice to the suction zone for the staple fibers was designed as a radial bore at the end of the jet acceleration channel. An improvement could be achieved in all cases, however, if an annular channel was formed round the suction blending head for the suction air.

The new invention also relates to apparatus for the industrial production of mixed yarn consisting of at least one continuous filament yarn and staple fibers with a plurality of units arranged in parallel and consisting of feed units, air jet and winding unit with drive as well as control units and is characterized in that the air jets are designed as air texturing jets combined with a suction blending head for feeding staple fibers which can be supplied via a staple fiber feed unit in each case. The staple fibers can either be taken from a flyer bobbin and be fed to the suction blending head after drawing or can be removed from a can and be added after corresponding release.

The new invention also allows an entire machine to be designed in such a way that it can be used selectively for the production of traditional textured filament yarns or mixed yarns or composite yarns. Tests have shown that the apparatus or machine itself can be operated in such a way that a continuous filament, whether alone or in addition to staple fibers, are fed into the suction blending head. It can now be seen that this variation allows further broadening of application and an increase in the variety of products.

The new invention also relates to a mixed yarn consisting of at least one continuous filament yarn as well as staple fibers and is characterized in that the mixed yarn is manufactured as a twist-free loop yarn by the air jet texturing process, the staple fibers being undisplaceably bound into the loops of the continuous filaments. All earlier tests were based on the manufacture of textured yarns having counts in the range of 50–1000 dtex. With the present state of knowledge, the range can easily be greater.

BRIEF DESCRIPTION OF THE DRAWINGS

FIGS. 1 to 5 show various solutions for the airstream treatment and modification of continuous filament yarns according to the prior art which have been described at the outset.

Some embodiments of the new invention will now be described with reference to the drawings.

Figure 6:
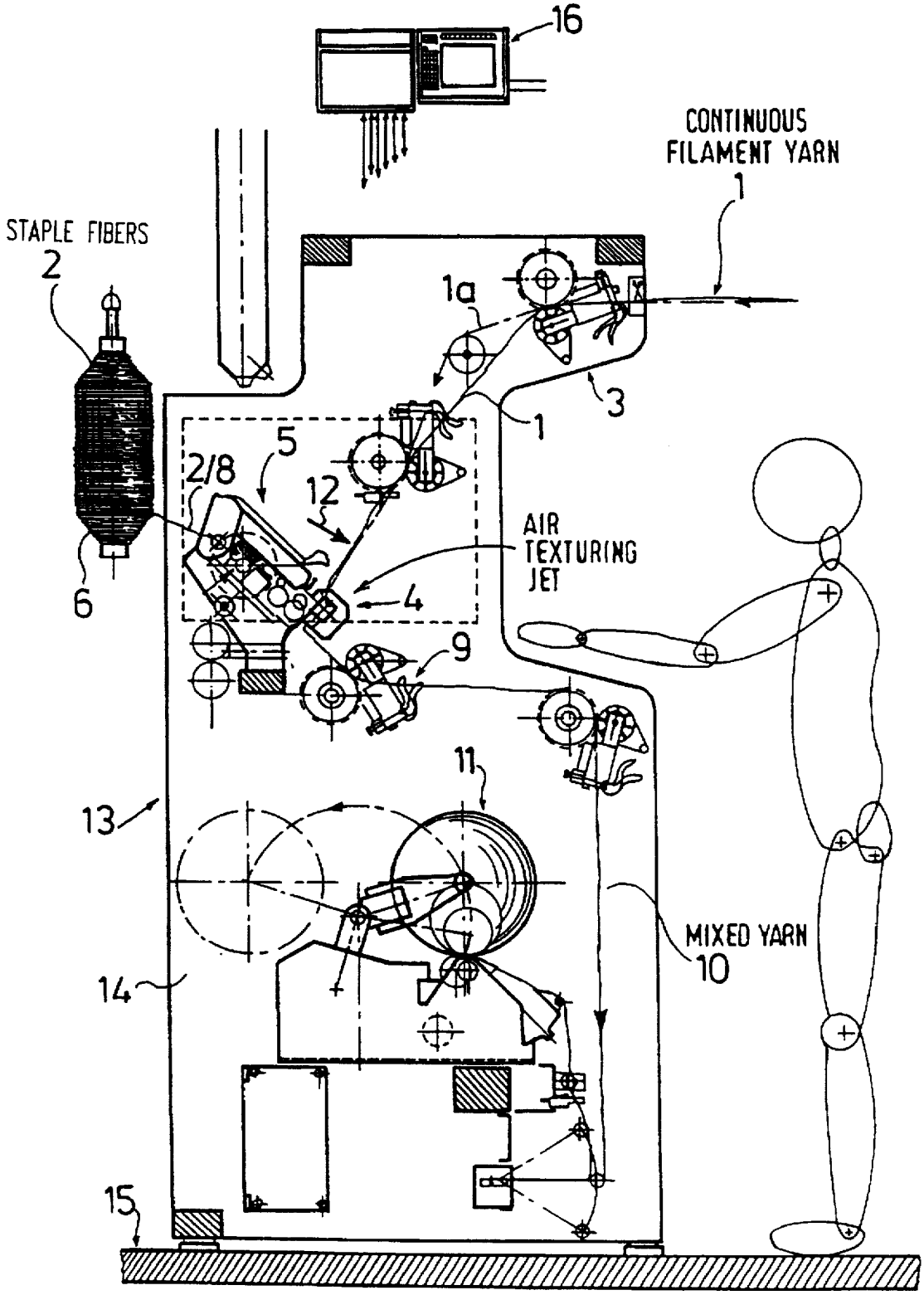

FIG. 6 is a highly simplified cross section through an entire machine.

Figure 9:
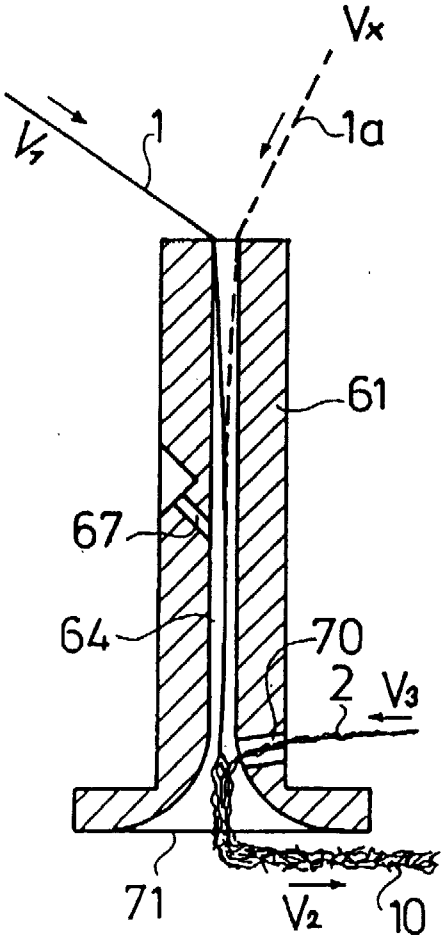
Figure 8:
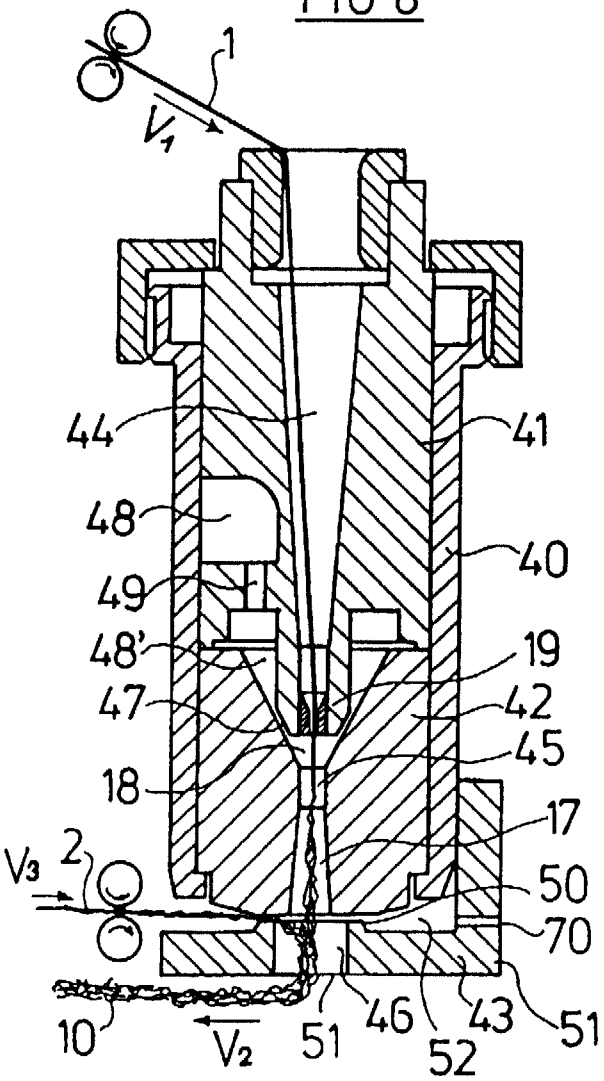
Figure 7:
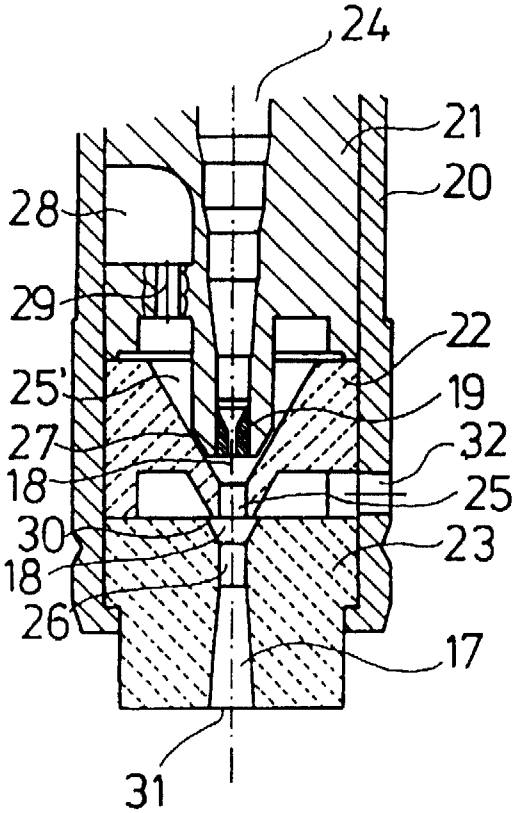

FIGS. 7, 8 and 9 each show a section through three different air texturing jets with suction blending head.

Figure 10:
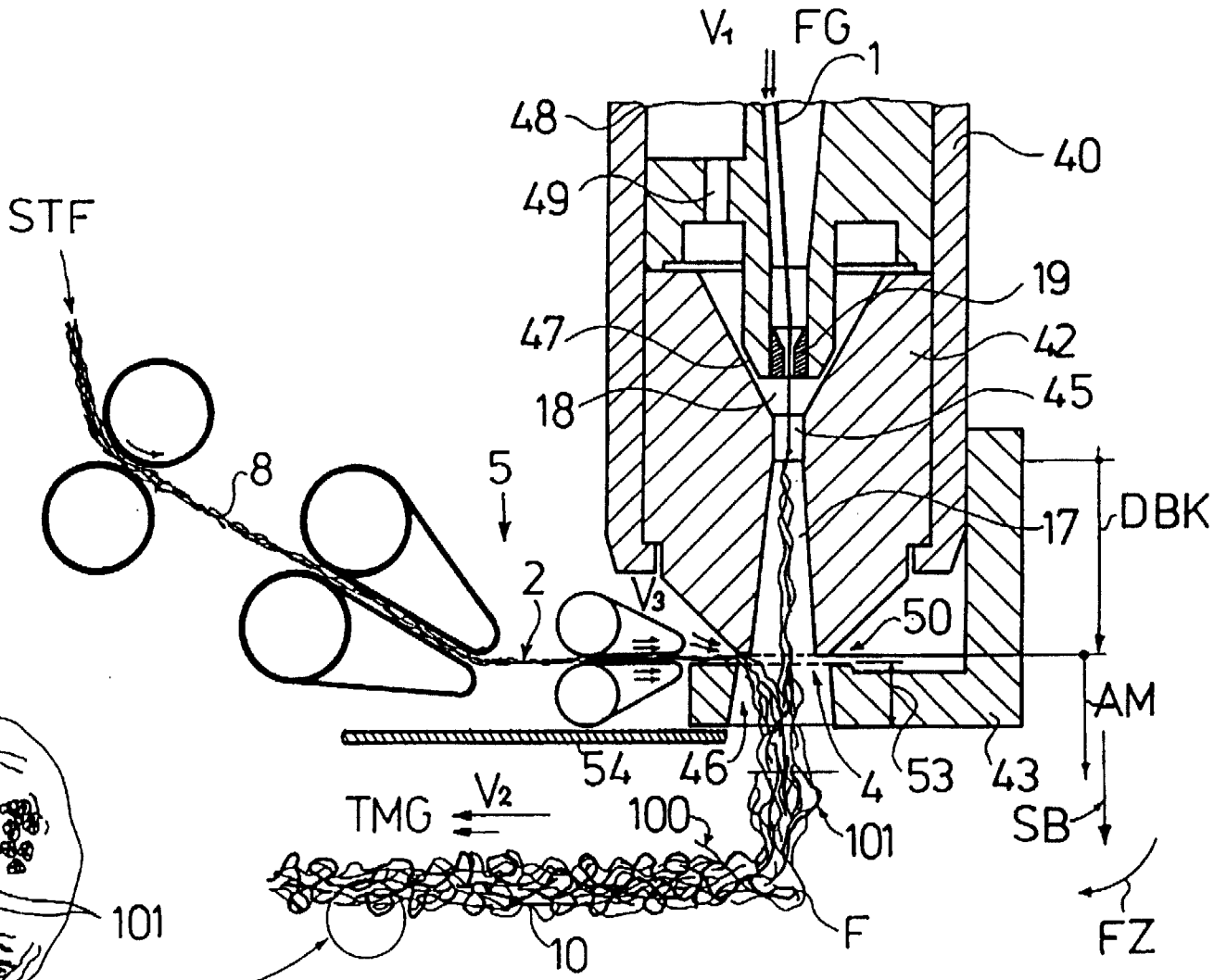

FIG. 10 shows a detail of the apparatus according to FIG. 8 on an enlarged scale.

Figure 11:
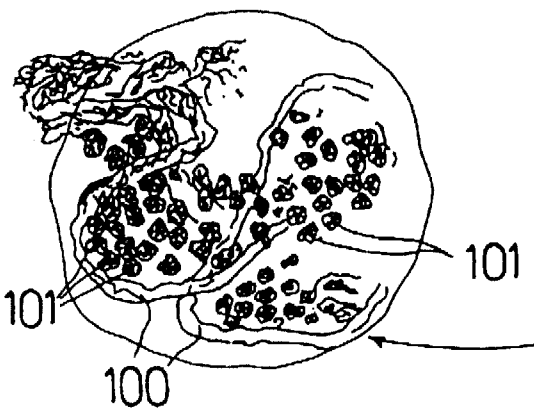

FIG. 11 is a micro section through a mixed yarn according to the invention.

Figure 12:
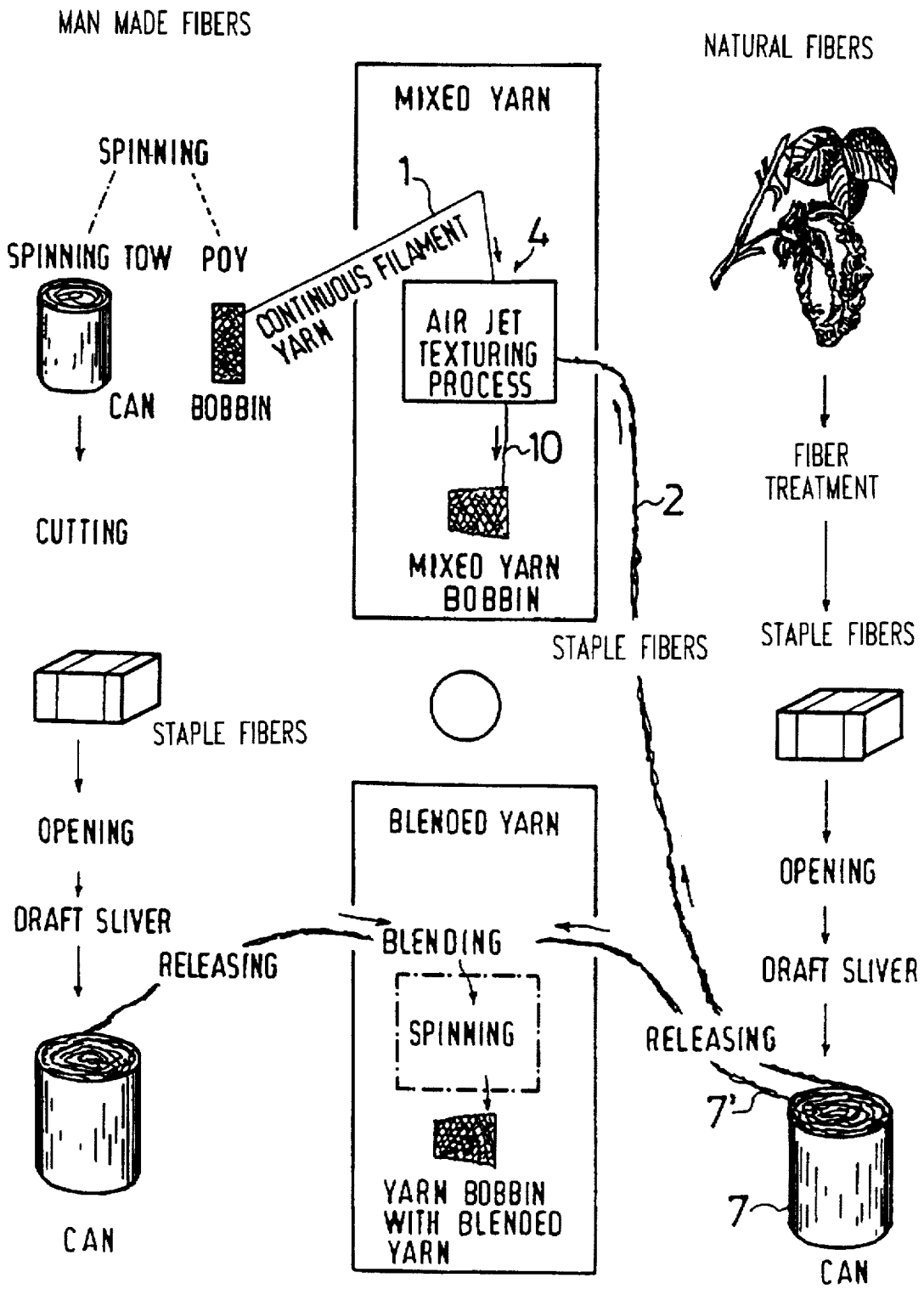

FIG. 12 shows a comparison of the conventional spinning process for a blended yarn and of the new air jet texturing process for the manufacture of a mixed yarn embodying the invention.

DESCRIPTION OF THE PREFERRED EMBODIMENTS

The air jet machine shown in FIG. 6 serves for the manufacture of a mixed yarn from at least one (two or more) continuous filament yarn 1 and staple fibers 2. The continuous filament yarn 1 is supplied by a filament feed unit 3 to an air jet texturing unit 4 and passes through a continuous yarn channel therein. The staple fibers 2 are taken from a flyer bobbin 6 via a fiber drawing system 5 as a draft sliver. As shown in FIG. 12, the fiber material can also be removed from a can 7 and can be supplied via a corresponding release unit to the air jet texturing unit 4. A take-off unit 9 is arranged after the outlet end of the yarn channel. After the take-off unit 9, the finished mixed yarn 10 then runs to a winding unit 11. The fiber drawing system 5 is preferably designed in such a way that it guides the ends of the staple fibers close to the suction zone, at least until the beginning of the process of binding the tips into the loops of the continuous filament yarn. A liquid can be supplied to the continuous filament yarn 1 before it enters the yarn channel of the air jet texturing unit 4 by means of a schematically indicated wetting unit, arrow 12. This liquid, preferably water, then passes together with the filament yarn 1 into the yarn channel of the texturing unit and assists the texturing process there. The new air jet texturing machine 13 can be similar in its basic structure to the known air jet machines with a plurality of production units over the entire length (not shown) of the machine, which stands on the floor 15 via pillars 14. It will be possible in many applications to modify the formerly known loop yarn from one or more continuous filaments or to manufacture the new mixed yarn using the same air jet texturing unit 4. Explained in simple terms, the type of end product decides whether or not additional staple fibers are to be supplied and whether or not the fiber drawing system 5 is to be set into operation. Only a single fiber feed unit is shown for the sake of simplicity. However, two or more fiber feed units can also be allocated to an air jet texturing unit 4. All fed units are designed in such a way that the respective feed velocity can be selected and controlled, for example by known speed-controlled drives. The entire installation is guided and monitored by a computer 16. Therefore, the optimum operating conditions, in particular the optimum feed and take-off velocities, can be adjusted, monitored and controlled for each case.

FIG. 7 shows a schematic longitudinal section through the core elements of a first embodiment of the air jet texturing unit 4. According to FIG. 7, three bodies 21, 22 and 23 are held so as to abut against one another in a cylindrical tube 20 and have axial bores 24 or 25 or 26. The bores 24, 25 and 26 are orientated coaxially to one another and together form a continuous yarn channel, for example for the passage of continuous multi-filament yarn 1 and 1*a* (FIG. 9). The yarn channel is essentially divided into three portions, a first, conically tapering inlet portion 24, a guide bush 19 which has a narrow point in the sense of a needle eye and an adjoining jet portion in whose central part the bore 26 is located. The main components of the jet portion are a feed point 18 for the continuous filament yarn into the high pressure airstream and a jet acceleration channel 17. Between a conical enlargement 25' of the bore 25 in the body 22 and a conical peripheral face at one end of the body 21 there is formed a jet annular gap 27 through which compressed air is introduced laterally into the yarn channel in the form of a jet. The compressed air preferably at 6–10 bar is introduced from a source (not shown) via a chamber 28 and one or more bores 29 in the body 21 to an annular space provided above the annular gap 27. The compressed air jet produces a supersonic airflow in the jet acceleration channel 17. A second annular gap 30 opens into the bore 26 in the yarn channel at a point which is designed as a suction zone and is located after the nozzle annular gap 27 in the direction of travel of the continuous filament yarn 1. The suction zone is located between the annular gap 27 and the bore 26 and is produced by the airstream which is blown downwardly from the jet annular gap 27 through the bore 26. The vacuum is produced in that the cross-sectional area in the region of the annular gap 30 is greater than the cross-sectional area of the bore 25. Staple fibers can be introduced into the yarn channel through the second annular gap 30. Staple fibers are introduced through a bore 32 in the tube 20 and in the body 23 into an annular space which is located above the annular gap 30 and is worked between the body 22 and the body 23. The outlet end or mouthpiece of the jet acceleration channel is designated by 31.

FIG. 8 is a schematic longitudinal section through an air texturing jet of a second embodiment of the air jet texturing unit 4 which was formerly the best. Two bodies 41 and 42 with axial bores 44 and 45 abut against one another in a cylindrical tube 40. A third body designed as a suction blending head 51 is fastened on the tube 40. The suction blending tube 51 has a plate 43 extending transversely over the lower end of the body 42. The plate 43 is arranged with small spacing from this lower end and thus forms an annular gap 50. The plate 43 contains a conical bore 46 forming a suction zone. The bores 44 and 45 are orientated substantially coaxially to one another and together form a continuous yarn channel for the passage of the continuous filament yarn 1. At the inlet point 18, an annular gap forms a drive jet 47 through which compressed air is introduced into the yarn channel 45. The compressed air is introduced from a source (not shown) via a chamber 48 and one or more bores 49 in the body 41 into the annular space 48'. A high pressure air jet is orientated by the drive jet 47 through the inlet point 18 into the bore 45. A suction annular gap 50 and annular channel 52 which opens into the conical bore 46 is formed between the lower end of the body 42 and the upper side of the plate 43. A vacuum is produced at this point by the downwardly directed airstream as the narrowest cross-sectional area of the bore 46 is greater in the plate 43 than the outlet cross section of the supersonic jet channel 17. Staple fibers 2 can be introduced into the suction zone 46 through the second annular gap 50. However, it is also possible to introduce staple fibers or a second filament through a further bore 70'.

FIG. 9 is a longitudinal section through the core element of a third embodiment of the air jet texturing unit 4. According to FIG. 9, a body 61 contains a elongate bore 64 which opens in a lower end portion to an outlet end 71. The continuous filament yarn 1 and possibly other continuous filaments 1*a* etc. run through this elongate bore 64. An air feed bore 67 through which compressed air is introduced into the yarn channel 64 opens laterally into the elongate bore or the yarn channel 64 at an acute angle to the direction of movement of the yarn 1. Although only one air feed bore 67 is illustrated, two or more such air feed bores could also open laterally into the yarn channel 64. The compressed air is fed from a source (not illustrated) to the air feed bore 67 or the air feed bores. A fiber feed bore 70 opens laterally into the yarn channel at a point between the air feed bore 67 and the outlet end 71 of the yarn channel. It is the point where a vacuum prevails in the airstream blown downwardly from the air feed bore 67 in the yarn channel 64 because the passage cross section for the airstream is enlarged in the form of a trumpet toward the outlet end 71. Staple fibers 2 are introduced through the fiber feed bore 70. Only one fiber feed bore 70 is illustrated; as in the other examples shown, however, two or more such feed bores 70 could also open laterally into the yarn channel 64, in which case various staple fibers or possibly filaments can optionally be fed through each of these bores. Texturing takes place in the region of the outlet end 71 and therebelow.

Reference will be made hereinafter to FIG. 10 which illustrates the texturing process. The jet portion of FIG. 10 corresponds to the solution according to FIG. 8. It has been found that a first important point is a clean design of the inlet point 18 for the continuous filament yarn. The main task is to use the drive jet 47 to bring the high pressure jet together with the continuous filament 1 into the bore 45 in such a way that the maximum possible energy of the compressed air is maintained. An excess pressure is adjusted in the inlet point 18 of the texturing jet in the operating state. The second important point is the design of the jet acceleration channel 17 (DBK). Uncontrollable interlacing must not take place in the jet acceleration channel but rather a supersonic airflow must be produced, by means of which the continuous filament yarn is opened. The individual filaments firstly begin to slide against one another so that each individual filament receives inherent movement. A jump in cross section exists in the region of the annular gap 50 as the cross-sectional area at the outlet end of the jet acceleration channel 17 to the bore 46 in the plate 43 suddenly becomes greater. The supersonic airflow in the jet acceleration channel 17 therefore passes into a shock wave airflow at this point and has a pronounced suction effect relative to the environment and is utilised as a suction zone. The best results could be achieved in the past if the staple fibers were introduced directly at the jump in cross section. A suction zone U is formed in the suction blending head 43. The length dimension 53 of the protected suction blending zone U can be relatively small. However, it should be at least 10%, preferably 50%–100% of the length of the jet acceleration channel 17. However, the actual length of the suction blending zone (AM) is effectively longer than the part protected by the conical bore 46. The loop forming zone is marked with SB and the braiding zone with FZ. In the region of the braiding point F, the mixed yarn 10 is taken off substantially at right angles to the left, as indicated by two arrows, as textured mixed yarn (TMG). A barrier device 54 protects the fiber feed from an undesirable airstream from the suction effect of the shock wave airflow. In the solution shown in FIG. 10, as in FIG. 6, the staple fibers 2 are supplied as a draft sliver 8' and are added via a fiber drawing system 5 into the suction zone at the desired velocity and in the desired quantity. It is advantageous if the staple fibers 2 are guided as close as possible to the suction zone U and, as in the example illustrated, are held mechanically until just before transfer. The binding of the staple fibers can therefore be kept under control even if the fiber length is very short. Very good results have been achieved with a solution according to FIG. 10 with a synthetic fiber content (continuous filament yarn) of 60–70% corresponding to about 30–40% of cotton fibers. The overfeed was a maximum of 40%, the pressure was 6–8 bar, the take-off velocity about 250 m/min. The feed rate of the staple fibers could be varied between ±10–20% of the take-off velocity.

The microscopic section according to FIG. 11 shows a detail of a textured mixed yarn (10). A large number of filaments 101 which bind the individual fibers 100 can be seen.

FIG. 12 is a comparison between the entire processes from the raw material to the finished product. On the one hand the path from the original fiber to the finally spun yarn is shown and on the other hand the path from the continuous filament and the staple fiber to the mixed yarn according to the invention.

We claim:

1. Method of manufacturing a mixed yarn in an airstream, the yarn having at least one continuous filament yarn and staple fibers, the method comprising the steps of:

supplying the continuous filament yarn in a jet airstream;

forming a suction zone in the jet airstream;

adding the staple fibers to the continuous filament yarn in the suction zone; and air jet texturizing the continuous filament yarn and staple fibers as mixed yarn.

2. Method according to claim 1, wherein an annular gap for the feeding of the staple fibers is formed in a first portion of the suction zone and the annular gap, the annular gap being arranged around an entire periphery of the suction zone or only a portion of the periphery of the suction zone.

3. Method according to claim 1, wherein the suction zone is designed as a suction blending chamber in such a way that a free outlet cross section is formed in the direction of the airstream and air jet texturing is carried out in part outside the suction blending chamber.

4. Method according to claim 3, wherein the continuous filament yarn is opened before it enters a suction blending chamber, the suction zone being in the blending chamber, by a steadily widening jet acceleration channel.

5. Method according to claim 4, wherein the transition from the jet channel into the suction blending chamber is formed by an irregular enlargement in cross section or a jump in cross section and the suction zone (U) is formed, into which the staple fibers are sucked via a bore or an annular gap.

6. Method according to claim 5, wherein the suction blending chamber is limited at the back and at the sides in the manner of an enveloping bell and is completely open in the direction of flow and passes directly into a free loop forming portion.

7. Method according to claim 6, wherein the suction blending chamber is open in the direction of flow and a loop formation and a braiding zone having a braiding point (F) are positioned after the suction blending chamber and are designed so as to be impact-free.

8. Method according to claim 7, wherein the textured mixed yarn is taken from the braiding point substantially at right angles to the airstream.

9. Method according to claim 8, wherein the staple fibers are fed into the suction blending chamber on one side with a radial component and the textured mixed yarn is taken from the braiding point in the opposite direction to a feed direction of the staple fibers.

10. A yarn produced by a method according to claim 1.

11. Method of manufacturing a mixed yarn having at least one continuous filament yarn and staple fibers, the method comprising the steps of (a) supply the continuous filament yarn in a jet airstream;

(b) opening the filament yarn by guiding the yarn with overfeed through a widening jet acceleration channel of an air texturizing jet;

(c) blending the staple fibers into the opened filament by sucking the staple fibers into the airstream by a feeder;

(d) converting the airstream into a shock wave airflow which forms, on the filaments, loops which embrace and bind the staple fibers;

(e) taking off the resulting textured mixed yarn substantially at right angles to the airstream.

12. Apparatus for manufacturing a mixed yarn from at least one continuous filament yarn and staple fibers comprising:

an air jet having a filament yarn flow path therethrough;

a suction zone associated with the air jet and positioned along the filament yarn flow path, the suction zone having a staple fiber feed, wherein said air jet includes a jet acceleration channel for forming loops in the filament yarn, the staple fibers being bound in the loops.

13. The apparatus as in claim 12, wherein the jet accelerating channel is configured to provide supersonic air flow.

14. The apparatus as in claim 12, wherein the suction zone and the staple fiber feed are positioned at an outlet of the jet accelerating channel.

15. The apparatus as in claim 12, wherein the suction zone and the staple fiber feed are positioned upstream of an outlet of the jet accelerating channel.

16. The apparatus as in claim 12, wherein the accelerating jet channel includes a segment selected from the group consisting of a conical portion and a trumpet-shaped conical portion.

17. The apparatus as in claim 12, wherein the suction zone is defined in part by an abrupt or rapid increase in the cross-sectional flow area relative to the flow area immediately upstream along the filament yarn flow path.

18. The apparatus as in claim 12, wherein the staple fiber feed is selected from the group consisting of orifices, annular gaps, and partial annular gaps.

19. The apparatus as in claim 12, wherein the jet accelerating channel includes an upstream bore portion and a conically diverging downstream portion, wherein said suction zone is formed in the bore portion as a chamber with an abrupt enlarged change in cross-sectional flow area relative to the bore flow area.

20. The apparatus as in claim 19, wherein the suction zone is formed by abutting air texturizing jet housing portions, said abutting housing portions also defining the staple fiber feed in the form of an annular gap.

21. The apparatus as in claim 12, wherein the jet accelerating channel includes a conically diverging portion, said suction zone being formed by an air jet housing portion having said conical diverging portion and a plate member spaced from said outlet and having an aperture axially in-line with said conically diverging portion, said plate aperture providing an abrupt increase in the cross-section flow area relative to the outlet flow area.

22. The apparatus as in claim 21, wherein said air jet includes a guide bush through which the filament yarn is fed and a conically converging annular gap surrounding said guide bush and oriented to provide a drive jet.

23. The apparatus as in claim 21, wherein said spaced plate member and said housing portion define the staple fiber feed in the form of an annular gap at the location of the abrupt increase in flow area.

24. The apparatus as in claim 21, wherein the plate aperture is cortically diverging.

25. The apparatus as in claim 21, further including a barrier member positioned between an entrance of the staple fiber feed and an exit of the plate aperture.

26. The apparatus as in claim 21, further including means for guiding the staple fibers to an entrance to the staple fiber feed.

27. The apparatus as in claim 21, wherein a protected distance from the outlet of the jet accelerating channel to an exit of the plate aperture is greater than about 10% of the length of the jet accelerating channel.

28. The apparatus as in claim 27, wherein the protected distance is between about 50–100% of the length of the jet accelerating channel.

29. The apparatus as in claim 12, wherein said jet accelerating channel includes an upstream bore portion and a downstream portion continuously enlarging in flow area along the filament yarn flow path, said downstream portion having a slowly increasing first portion and a rapidly increasing second portion terminating in a free open end outlet, said downstream portion also comprising said suction zone, said staple fiber feed including at least one orifice in flow communication with said downstream portion.

30. The apparatus as in claim 29, wherein said downstream portion is smoothly increasing in a trumpet shape.

* * * * *

UNITED STATES PATENT AND TRADEMARK OFFICE

CERTIFICATE OF CORRECTION

PATENT NO. : 5,640,745

DATED : June 24, 1997

INVENTOR(S) : Gotthilf BERTSCH, et al.

It is certified that error appears in the above-indentified patent and that said Letters Patent is hereby corrected as shown below:

ABSTRACT, front page, line 3, after "fibers" insert --is disclosed--.

Claim 16, column 9, lines 60 and 61, change "accelerating jet" to --jet accelerating--.

Claim 24, column 10, line 36, change "cortically" to --conically--.

Signed and Sealed this

Thirtieth Day of September, 1997

*Attest:*

Bruce Lehman

BRUCE LEHMAN

*Attesting Officer*

*Commissioner of Patents and Trademarks*